US008346546B2

(12) United States Patent
Chen

(10) Patent No.: US 8,346,546 B2
(45) Date of Patent: Jan. 1, 2013

(54) PACKET LOSS CONCEALMENT BASED ON FORCED WAVEFORM ALIGNMENT AFTER PACKET LOSS

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1331 days.

(21) Appl. No.: 11/831,835

(22) Filed: Jul. 31, 2007

(65) Prior Publication Data

US 2008/0046235 A1 Feb. 21, 2008

Related U.S. Application Data

(60) Provisional application No. 60/837,640, filed on Aug. 15, 2006.

(51) Int. Cl.
*G10L 21/00* (2006.01)

(52) U.S. Cl. ..... 704/228; 704/207; 704/208; 704/218

(58) Field of Classification Search ..... 704/207, 704/208, 218, 228
See application file for complete search history.

(56) References Cited

U.S. PATENT DOCUMENTS

| | | | | |
|---|---|---|---|---|
| 6,418,408 | B1 * | 7/2002 | Udaya Bhaskar et al. | 704/219 |
| 6,691,092 | B1 * | 2/2004 | Udaya Bhaskar et al. | 704/265 |
| 6,829,578 | B1 * | 12/2004 | Huang et al. | 704/211 |
| 6,959,274 | B1 * | 10/2005 | Gao et al. | 704/219 |
| 6,961,697 | B1 * | 11/2005 | Kapilow | 704/228 |
| 7,529,660 | B2 * | 5/2009 | Bessette et al. | 704/205 |
| 2001/0008995 | A1 * | 7/2001 | Kim et al. | 704/223 |
| 2002/0048376 | A1 * | 4/2002 | Ukita | 381/92 |
| 2003/0009325 | A1 * | 1/2003 | Kirchherr et al. | 704/211 |
| 2003/0078769 | A1 * | 4/2003 | Chen | 704/211 |
| 2003/0220787 | A1 * | 11/2003 | Svensson et al. | 704/207 |
| 2005/0053242 | A1 * | 3/2005 | Henn et al. | 381/22 |
| 2005/0065782 | A1 * | 3/2005 | Stachurski | 704/205 |
| 2005/0166124 | A1 * | 7/2005 | Tsuchinaga et al. | 714/776 |
| 2005/0240402 | A1 * | 10/2005 | Kapilow | 704/229 |
| 2006/0167693 | A1 * | 7/2006 | Kapilow | 704/258 |
| 2006/0265216 | A1 | 11/2006 | Chen | |
| 2007/0027680 | A1 * | 2/2007 | Ashley et al. | 704/207 |
| 2007/0036360 | A1 * | 2/2007 | Breebaart | 381/23 |
| 2007/0136052 | A1 * | 6/2007 | Gao et al. | 704/207 |

FOREIGN PATENT DOCUMENTS

JP 03080300 A * 4/1991

* cited by examiner

*Primary Examiner* — Daniel D Abebe
(74) *Attorney, Agent, or Firm* — Fiala & Weaver P.L.L.C.

(57) ABSTRACT

A packet loss concealment method and system is described that attempts to reduce or eliminate destructive interference that can occur when an extrapolated waveform representing a lost segment of a speech or audio signal is merged with a good segment after a packet loss. This is achieved by guiding a waveform extrapolation that is performed to replace the bad segment using a waveform available in the first good segment or segments after the packet loss. In another aspect of the invention, a selection is made between a packet loss concealment method that performs the aforementioned guided waveform extrapolation and one that does not. The selection may be made responsive to determining whether the first good segment or segments after the packet loss are available and also to whether a segment preceding the lost segment and the first good segment following the lost segment are deemed voiced.

18 Claims, 6 Drawing Sheets

PACKET LOSS CONCEALMENT BASED ON FORCED WAVEFORM ALIGNMENT AFTER PACKET LOSS

CROSS-REFERENCE TO RELATED APPLICATIONS

This application claims priority to Provisional U.S. Patent Application No. 60/837,640, filed Aug. 15, 2006, the entirety of which is incorporated by reference herein.

BACKGROUND OF THE INVENTION

1. Field of the Invention

The present invention relates to digital communication systems. More particularly, the present invention relates to the enhancement of speech or audio quality when portions of a bit stream representing a speech signal are lost within the context of a digital communication system.

2. Background Art

In speech coding (sometimes called "voice compression"), a coder encodes an input speech or audio signal into a digital bit stream for transmission. A decoder decodes the bit stream into an output speech signal. The combination of the coder and the decoder is called a codec. The transmitted bit stream is usually partitioned into segments called frames, and in packet transmission networks, each transmitted packet may contain one or more frames of a compressed bit stream. In wireless or packet networks, sometimes the transmitted frames or packets are erased or lost. This condition is called frame erasure in wireless networks and packet loss in packet networks. When this condition occurs, to avoid substantial degradation in output speech quality, the decoder needs to perform frame erasure concealment (FEC) or packet loss concealment (PLC) to try to conceal the quality-degrading effects of the lost frames.

For a PLC or FEC algorithm, the packet loss and frame erasure amount to the same thing: certain transmitted frames are not available for decoding, so the PLC or FEC algorithm needs to generate a waveform to fill up the waveform gap corresponding to the lost frames and thus conceal the otherwise degrading effects of the frame loss. Because the terms FLC and PLC generally refer to the same kind of technique, they can be used interchangeably. Thus, for the sake of convenience, the term "packet loss concealment," or PLC, is used herein to refer to both.

When a frame of transmitted voice data is lost, conventional PLC methods usually extrapolate the missing waveform based on only a waveform that precedes the lost frame in the audio signal. If the waveform extrapolation is performed properly, there will usually be no audible distortion during the lost frame (also referred to herein as a "bad" frame). Audible distortion usually occurs, however, during the first good frame or first few good frames immediately following a frame erasure or packet loss, where the extrapolated waveform needs to somehow merge with the normally-decoded waveform corresponding to the first good frame(s). What often happens is that the extrapolated waveform can be out of phase with respect to the normally-decoded waveform after a frame erasure or packet loss. Although the use of an overlap-add method will reduce waveform discontinuity, it cannot fix the problem of destructive interference between the extrapolated waveform and the normally-decoded waveform after a frame erasure or packet loss if the two waveforms are out of phase. This is the main source of the audible distortion in conventional PLC systems.

SUMMARY OF THE INVENTION

A packet loss concealment method and system is described herein that attempts to reduce or eliminate destructive interference that can occur when an extrapolated waveform representing a lost segment of a speech or audio signal is merged with a good segment after a packet loss. An embodiment of the present invention achieves this by guiding a waveform extrapolation that is performed to replace the bad segment using a waveform available in the first good segment or segments after the packet loss.

In particular, a method for concealing a lost segment in a speech or audio signal that comprises a series of segments is described herein. In accordance with the method, an extrapolated waveform is generated based on a segment that precedes the lost segment in the series of segments and on one or more segments that follow the lost segment in the series of segments. A replacement waveform is then generated for the lost segment based on a first portion of the extrapolated waveform. Also, a second portion of the extrapolated waveform is overlap-added with a decoded waveform associated with the one or more segments following the lost segment in the series of segments.

The step of generating the extrapolated waveform in accordance with the foregoing method may itself comprise a number of steps. First, a first-pass periodic waveform extrapolation is performed using a pitch period associated with the segment that precedes the lost segment to generate a first-pass extrapolated waveform. A time lag is then identified between the first-pass extrapolated waveform and the decoded waveform associated with the one or more segments that follow the lost segment. A pitch contour is then calculated based on the identified time lag. Then, a second-pass periodic waveform extrapolation is performed using the pitch contour to generate the extrapolated waveform.

A computer program product is also described herein. The computer program product includes a computer-readable medium having computer program logic recorded thereon for enabling a processor to conceal a lost segment in a speech or audio signal that comprises a series of segments. The computer program logic includes first means, second means and third means. The first means are for enabling the processor to generate an extrapolated waveform based on a segment that precedes the lost segment in the series of segments and on one or more segments that follow the lost segment in the series of segments. The second means are for enabling the processor to generate a replacement waveform for the lost segment based on a first portion of the extrapolated waveform. The third means are for enabling the processor to overlap-add a second portion of the extrapolated waveform with a decoded waveform associated with the one or more segments following the lost segment in the series of segments.

In one embodiment, the first means includes additional means. The additional means may include means for enabling the processor to perform a first-pass periodic waveform extrapolation using a pitch period associated with the segment that precedes the lost segment to generate a first-pass extrapolated waveform. The additional means may also include means for enabling the processor to identify a time lag between the first-pass extrapolated waveform and the decoded waveform associated with the one or more segments that follow the lost segment. The additional means may further include means for enabling the processor to calculate a pitch contour based on the identified time lag and means for enabling the processor to perform a second-pass periodic waveform extrapolation using the pitch contour to generate the extrapolated waveform.

An alternate method for concealing a lost segment in a speech or audio signal that comprises a series of segments is also described herein. In accordance with this method, a determination is made as to whether one or more segments that follow the lost segment in the series of segments are available. If it is determined that the one or more segments that follow the lost segment are available, then packet loss concealment is performed using periodic waveform extrapolation based on a segment that precedes the lost segment in the series of segments and on the one or more segments that follow the lost segment. If, however, it is determined that the one or more segments that follow the lost segment are not available, then packet loss concealment is performed using waveform extrapolation based on the segment that precedes the lost segment but not on any segments that follow the lost segment.

This method may further include determining if the segment that precedes the lost segment and the first of the one or more segments that follow the lost segments are deemed voiced segments. If it is determined that the one or more segments that follow the lost segment are available and that the segment that precedes the lost segment and the first of the one or more segments that follow the lost segment are deemed voiced segments, then packet loss concealment is performed using periodic waveform extrapolation based on the segment that precedes the lost segment and on the one or more segments that follow the lost segment. If, however, it is determined that the one or more segments that follow the lost segment are not available or that either the segment that precedes the lost segment or the first of the one or more segments that follow the lost segment is not deemed a voiced segment, then packet loss concealment is performed using waveform extrapolation based on the segment that precedes the lost segment but not on any segments that follow the lost segment.

An alternate computer program product is also described herein. The computer program product includes a computer-readable medium having computer program logic recorded thereon for enabling a processor to conceal a lost segment in a speech or audio signal that comprises a series of segments. The computer program logic includes first means, second means and third means. The first means are for enabling the processor to determine if one or more segments that follow the lost segment in the series of segments are available. The second means are for enabling the processor to perform packet loss concealment using periodic waveform extrapolation based on a segment that precedes the lost segment in the series of segments and on the one or more segments that follow the lost segment responsive to a determination that the one or more segments that follow the lost segment are available. The third means are for enabling the processor to perform packet loss concealment using waveform extrapolation based on the segment that precedes the lost segment but not on any segments that follow the lost segment responsive to a determination that the one or more segments that follow the lost segment are not available.

The computer program product may further include means for enabling the processor to determine if the segment that precedes the lost segment and the first of the one or more segments that follow the lost segments are deemed voiced segments. In accordance with this embodiment, the second means includes means for enabling the processor to perform packet loss concealment using periodic waveform extrapolation based on the segment that precedes the lost segment and on the one or more segments that follow the lost segment responsive to a determination that the one or more segments that follow the lost segment are available and to a determination that the segment that precedes the lost segment and the first of the one or more segments that follow the lost segment are deemed voiced segments. In further accordance with this embodiment, the third means comprises means for enabling the processor to perform packet loss concealment using waveform extrapolation based on the segment that precedes the lost segment but not on any segments that follow the lost segment responsive to a determination that the one or more segments that follow the lost segment are not available or to a determination that either the segment that precedes the lost segment or the first of the one or more segments that follow the lost segment is not deemed a voiced segment.

Further features and advantages of the present invention, as well as the structure and operation of various embodiments of the present invention, are described in detail below with reference to the accompanying drawings. It is noted that the invention is not limited to the specific embodiments described herein. Such embodiments are presented herein for illustrative purposes only. Additional embodiments will be apparent to persons skilled in the art based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

The features and advantages of the present invention will become more apparent from the detailed description set forth below when taken in conjunction with the drawings. The drawing in which an element first appears is indicated by the leftmost digit(s) in the corresponding reference number.

DETAILED DESCRIPTION OF INVENTION

A. Introduction

Figure 1:
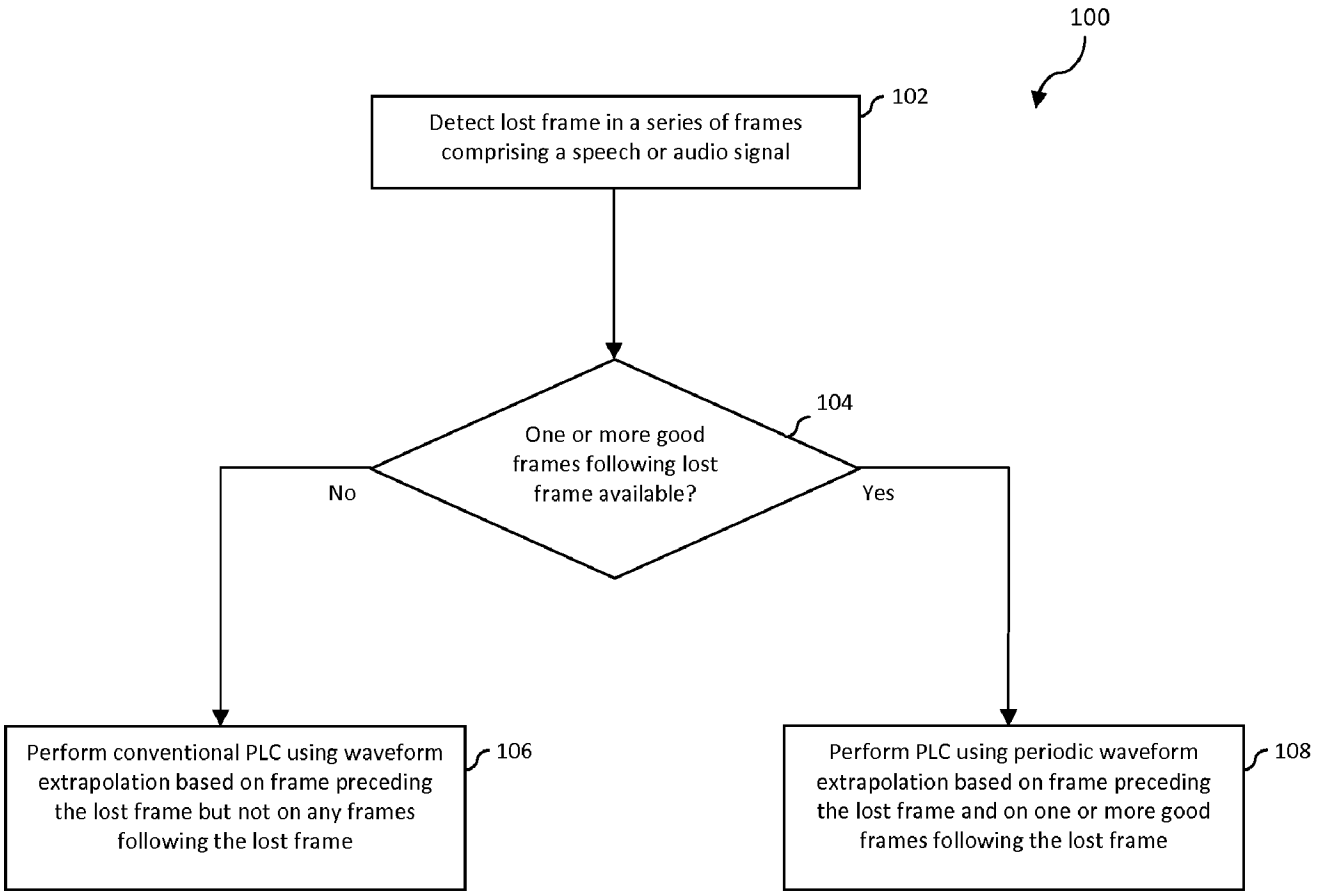
FIG. 1 depicts a flowchart of a method for performing packet loss concealment (PLC) in accordance with an embodiment of the present invention in which a selection is made between a conventional PLC technique and a novel PLC technique.

The following detailed description of the present invention refers to the accompanying drawings that illustrate exemplary embodiments consistent with this invention. Other embodiments are possible, and modifications may be made to the illustrated embodiments within the spirit and scope of the present invention. Therefore, the following detailed description is not meant to limit the invention. Rather, the scope of the invention is defined by the appended claims.

It will be apparent to persons skilled in the art that the present invention, as described below, may be implemented in many different embodiments of hardware, software, firmware, and/or the entities illustrated in the drawings. Any actual software code with specialized control hardware to implement the present invention is not limiting of the present invention. Thus, the operation and behavior of the present invention will be described with the understanding that modifications and variations of the embodiments are possible, given the level of detail presented herein.

It should be understood that the while the detailed description of the invention set forth herein refers to the processing of speech signals, the invention may be also be used in relation to the processing of other types of audio signals as well. Therefore, the terms "speech" and "speech signal" are used herein purely for convenience of description and are not limiting. Persons skilled in the relevant art(s) will appreciate that such terms can be replaced with the more general terms "audio" and "audio signal." Furthermore, although speech and audio signals are described herein as being partitioned into frames, persons skilled in the relevant art(s) will appreciate that such signals may be partitioned into other discrete segments as well, including but not limited to sub-frames. Thus, descriptions herein of operations performed on frames are also intended to encompass like operations performed on other segments of a speech or audio signal, such as sub-frames.

B. Packet Loss Concealment System and Method in Accordance with the Present Invention A packet loss concealment (PLC) system and method is described herein that attempts to reduce or eliminate destructive interference that can occur when an extrapolated waveform representing a lost frame of a speech or audio signal is merged with a good frame after a packet loss. An embodiment of the present invention achieves this by guiding a waveform extrapolation that is performed to replace the bad frame using a waveform available in the first good frame or frames after the packet loss. The good frame(s) can be made available by introducing additional buffering delay, or may already be available in a packet network due to the fact that different packets are subject to different packet delays or network jitters.

An embodiment of the present invention may be built on an approach previously described in U.S. patent application Ser. No. 11/234,291 to Chen (entitled "Packet Loss Concealment for Block-Independent Speech Codecs" and filed on Sep. 26, 2005) but can provide a significant performance improvement over the methods described in that application. While U.S. patent application Ser. No. 11/234,291 describes performing waveform extrapolation to replace a bad frame based on a waveform that precedes the bad frame in the audio signal, an embodiment of the present invention attempts to improve the output audio quality by also using a waveform associated with one or more good frames that follow the bad frame, whenever such waveform is available.

A likely application of the present invention is in voice communication over packet networks that are subject to packet loss, or over wireless networks that are subject to frame erasure.

FIG. 1 depicts a flowchart 100 of a method for performing PLC in accordance with an embodiment of the present invention. The method of flowchart 100 may be performed, for example, by a speech or audio decoder in a digital communication system. As will be readily appreciated by persons skilled in the relevant art(s), the logic for performing the method of flowchart 100 may be implemented in software, in hardware, or as a combination of software and hardware. In one embodiment of the present invention, the logic for performing the method of flowchart 100 is implemented as a series of software instructions that are executed by a digital signal processor (DSP).

As shown in FIG. 1, the method of flowchart 100 begins at step 102, in which a lost frame is detected in a series of frames that comprises a speech or audio signal. At decision step 104, a determination is made as to whether one or more good frames following the lost frame are available at the decoder. As noted above, the good frame(s) can be made available by introducing additional buffering delay, or may already be available in a packet network due to the fact that different packets are subject to different packet delays or network jitters. However, in some instances, no good frame(s) following the lost frame may be available. For example, no good frame(s) following the lost frame may be available in an instance where a packet loss or frame erasure extends over a large number of frames following the lost frame.

If it is determined during decision step 104 that no good frame(s) following the lost frame are available, then a conventional PLC technique is used to replace the lost frame as shown at step 106. The conventional PLC technique uses waveform extrapolation based on a frame preceding the lost frame but not on any frames that follow the lost frame. For example, the conventional PLC technique may be that described in U.S. patent application Ser. No. 11/234,291 to Chen, the entirety of which is incorporated by reference herein.

However, if it is determined during decision step 104 that one or more good frames following the lost frame are available, then a novel PLC technique is used to replace the lost frame as shown at step 108. The novel PLC technique performs waveform extrapolation based on a frame preceding the lost frame and on one or more good frames following the lost frame. In particular, and as will be described in more detail herein, the novel PLC technique decodes the first good frame or frames following the lost frame to obtain a normally-decoded waveform associated with the good frame(s). Then, the technique uses the normally-decoded waveform to guide a waveform extrapolation operation associated with the lost frame in such a way that when the waveform is extrapolated to the good frame(s), the extrapolated waveform will be roughly in phase with the normally-decoded waveform. This serves to eliminate or at least reduce any audible distortion due to destructive interference between the extrapolated waveform and the normally-decoded waveform.

For block-independent codecs that encode and decode each frame of a signal independently of any other frame of the signal, the normally-decoded signal waveform associated with the first good frame(s) after a packet loss will be identical to the normally-decoded signal waveform associated with those frames had there been no channel impairments. In other words, the packet loss does not have any impact on the decoding of the good frame(s) that follow the packet loss. In contrast, the decoding operations of most low-bit-rate speech codecs do depend on the decoded results associated with preceding frames. Thus, the degrading effects of a packet loss will propagate to good frames following the packet loss.

Hence, after a frame is lost, the decoded waveform associated with the next good frame will usually take some time to recover to the correct waveform. It should be noted that although the novel PLC method described herein works best with block independent codecs in which the decoded waveform associated with the first good frame following a packet loss immediately returns to the correct waveform, the invention can also be used with other codecs with block dependency, as long as the decoded waveform associated with the first good frame following a packet loss can recover back to the correct waveform in a relatively short period of time.

Figure 2:
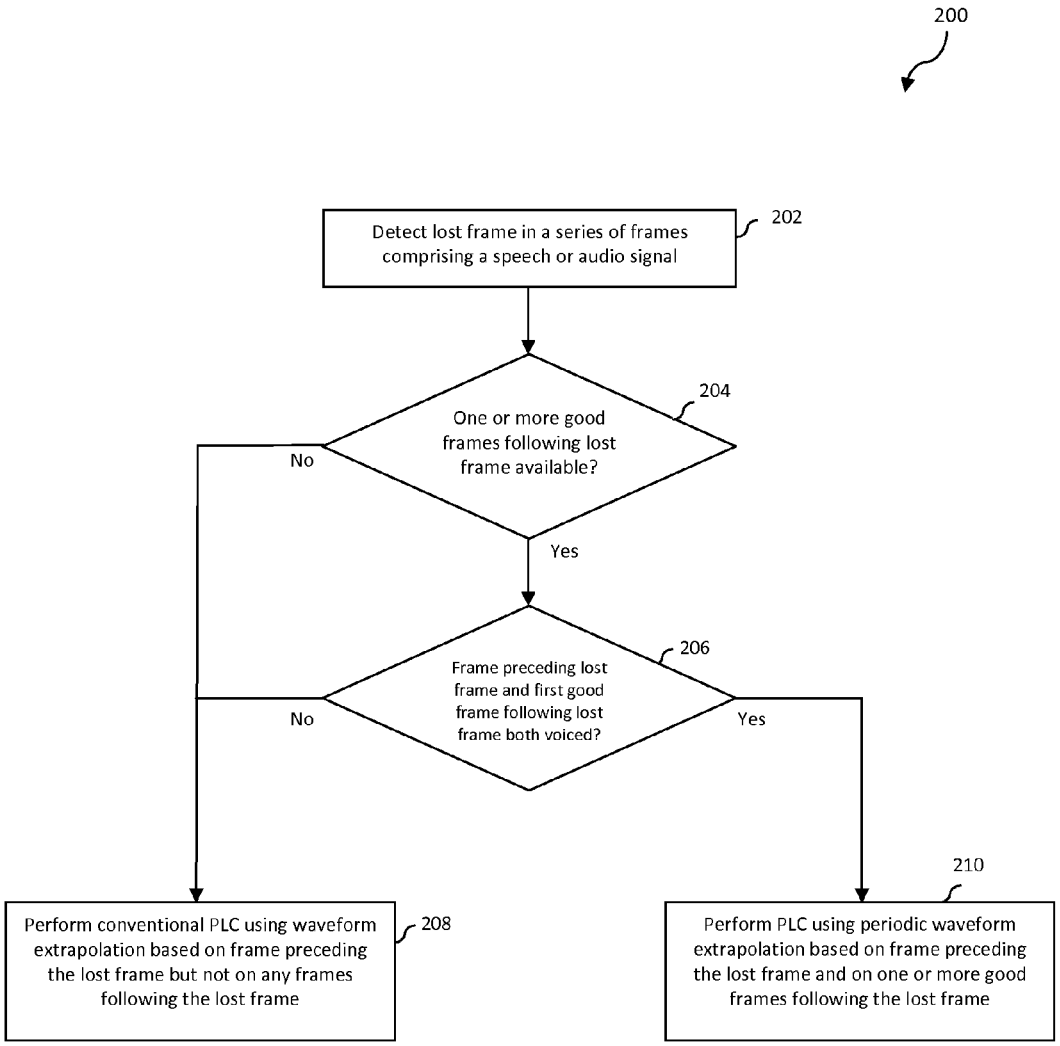
FIG. 2 depicts a flowchart of a further method for performing PLC in accordance with an embodiment of the present invention in which a selection is made between a conventional PLC technique and a novel PLC technique.

FIG. 2 depicts a flowchart 200 of a method for performing PLC in accordance with a further embodiment of the present invention. Like the method of flowchart 100 described above in reference to FIG. 1, the method of flowchart 200 uses the novel PLC technique described above in reference to step 108 of flowchart 100 only when one or more good frames following the lost frame are available at the decoder. However, in addition to requiring that one or more good frames following the lost frame be available to perform the novel PLC technique, the method of flowchart 200 also requires that both the frame immediately preceding the lost frame and the first good frame following the lost frame be deemed voiced frames. This requirement is premised on the recognition that the biggest destructive interference problem usually occurs during voiced regions of speech, especially when the pitch period is changing.

As shown in FIG. 2, the method of flowchart 200 begins at step 202, in which a lost frame is detected in a series of frames that comprises a speech or audio signal. At decision step 204, a determination is made as to whether one or more good frame(s) following the lost frame are available at the decoder. If it is determined during decision step 204 that no good frame(s) following the lost frame are available, then a conventional PLC technique is used to replace the lost frame as shown at step 208. As discussed above in reference to flowchart 100 of FIG. 1, the conventional PLC technique uses waveform extrapolation based on a frame preceding the lost frame but not on any frames that follow the lost frame. As also noted above, the conventional PLC technique may be that described in U.S. patent application Ser. No. 11/234,291 to Chen.

However, if it is determined during decision step 204 that one or more good frames following the lost frame are available, then control flows to decision step 206 in which a determination is made as to whether the frame immediately preceding the lost frame and the first good frame following the lost frame are deemed voiced frames. Any of a wide variety of techniques known to persons skilled in the relevant art(s) for determining whether a frame of a speech signal is voiced may be used to perform this step. If it is determined during step 206 that either the frame immediately preceding the lost frame or the first good frame following the lost frame is not deemed a voiced frame, then the conventional PLC technique is used to replace the lost frame as shown at step 208.

However, if it is determined during decision step 210 that both the frame immediately preceding the lost frame and the first good frame following the lost frame are deemed voiced frames, then a novel PLC technique is used to replace the lost frame as shown at step 210. As noted above in reference to flowchart 100 of FIG. 1, the novel PLC technique performs waveform extrapolation based on a frame preceding the lost frame and on one or more good frames that follow the lost frame.

Figure 3:
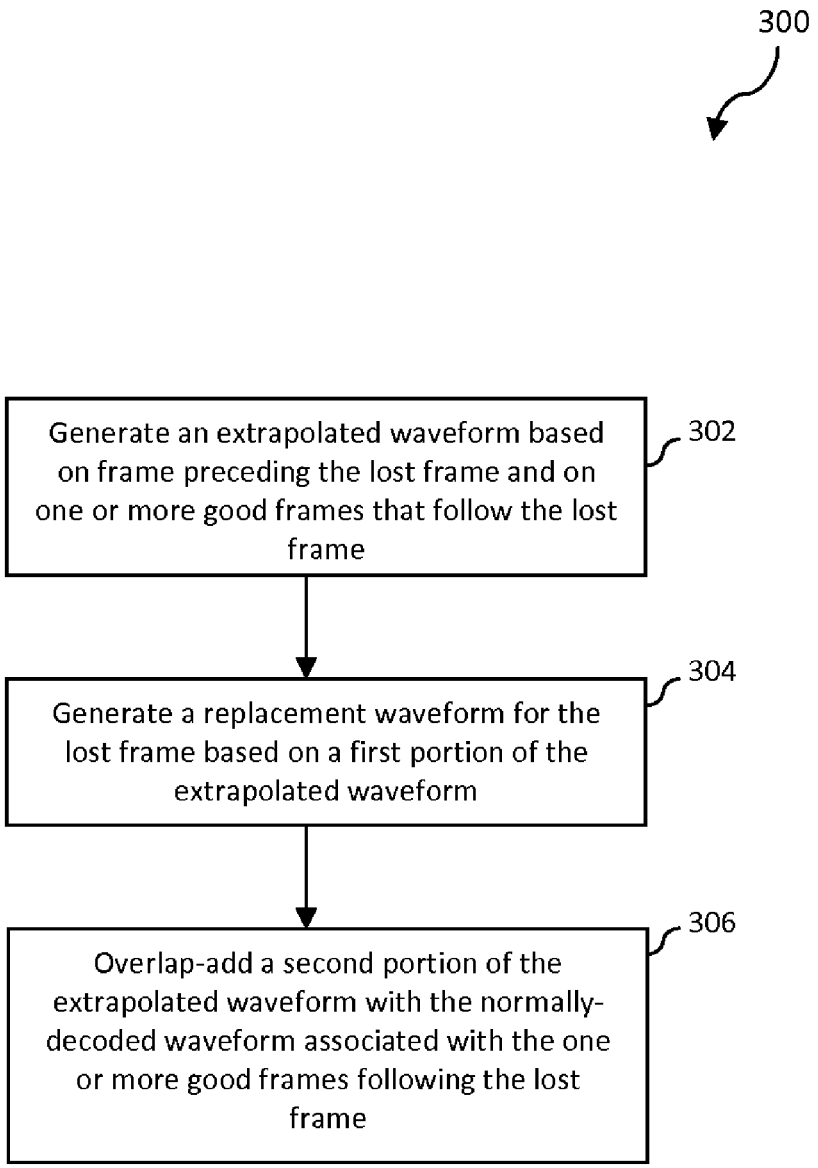
FIG. 3 depicts a novel method for performing PLC in accordance with an embodiment of the present invention.

FIG. 3 depicts a flowchart 300 of a particular method for performing the novel PLC technique discussed above in reference to step 108 of flowchart 100 and in reference to step 210 of flowchart 200. As shown in FIG. 3, the method begins at step 302, in which an extrapolated waveform is generated based on a frame that precedes the lost frame and on one or more good frames that follow the lost frame. At step 304, a replacement waveform is generated for the lost frame based on a first portion of the extrapolated waveform. At step 306, a second portion of the extrapolated waveform is overlap-added with a normally-decoded waveform associated with the one or more good frames that follow the lost frame. As will be described below, the extrapolated waveform is generated in such a manner such that when the second portion of the extrapolated waveform is overlap-added with the normally-decoded waveform associated with the one or more good frames that follow the lost frame, audible distortion due to destructive interference between the two waveforms is reduced or eliminated.

Figure 4:
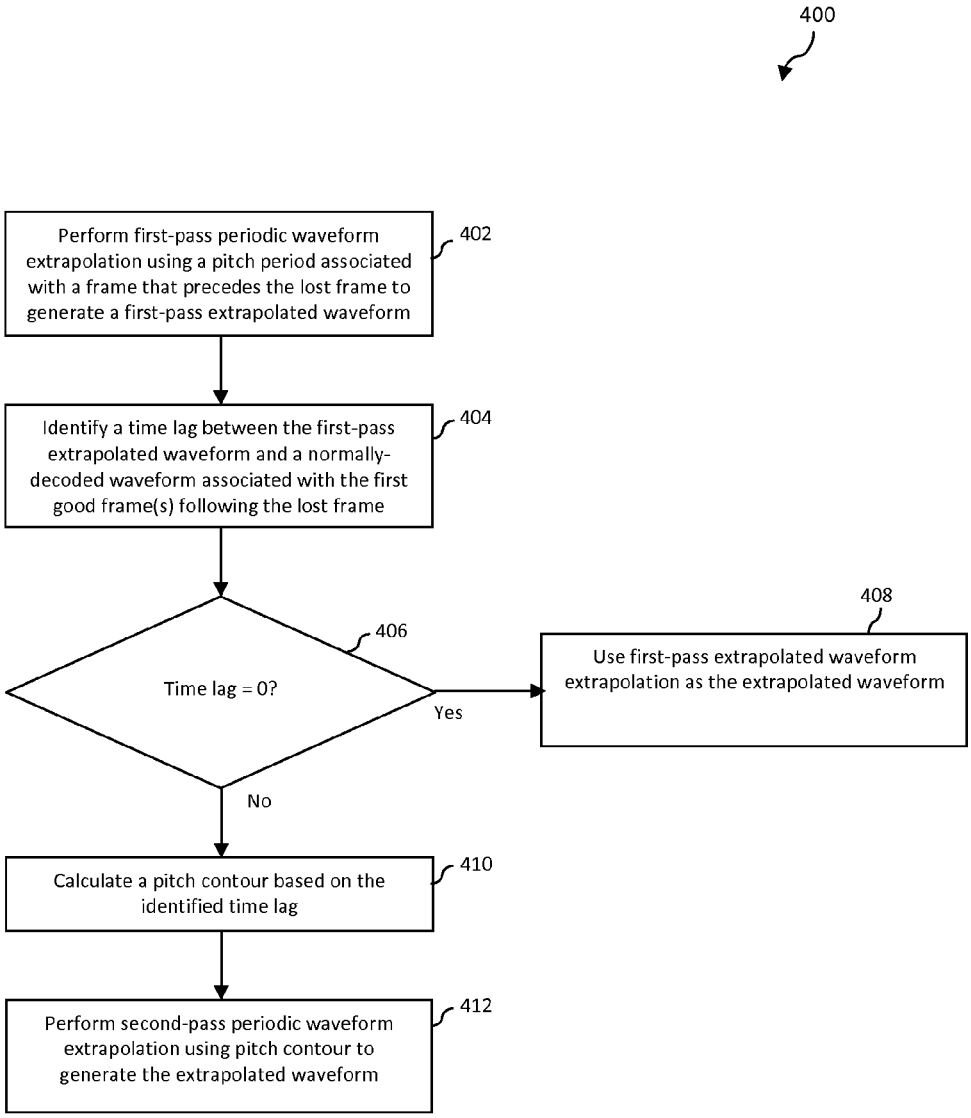
FIG. 4 depicts a flowchart of a method for extrapolating a waveform based on at least one frame preceding a lost frame in a series of frames and at least one frame that follows the lost frame in the series of frames in accordance with an embodiment of the present invention.

FIG. 4 depicts a flowchart 400 of a method for performing step 302 of flowchart 300 to produce an extrapolated waveform. As shown in FIG. 4, the method of flowchart 400 begins at step 402, in which a first-pass periodic waveform extrapolation is performed using a pitch period associated with a frame that immediately precedes the lost frame to generate a first-pass extrapolated waveform. The first-pass periodic waveform extrapolation may be performed, for example, using the method described in U.S. patent application Ser. No. 11/234,291, although the invention is not so limited. The first-pass periodic waveform extrapolation continues until the first good frame following the lost frame. In some implementations it may be advantageous to continue the first-pass periodic waveform extrapolation not just until the first good frame following the lost frame, but through the first two or three good frames following a packet loss if these additional good frames are available. However, for the sake of convenience, in the following discussion the phrase "the first good frame following the lost frame" will be used to represent either case.

At step 404, a time lag between the first-pass extrapolated waveform and a normally-decoded waveform associated with the first good frame(s) following the lost frame is identified. The time lag may be identified by performing a search for the peak of the well-known energy-normalized cross-correlation function between the first-pass extrapolated waveform and a normally-decoded waveform associated with the first good frame(s) following the lost frame for a time lag range around zero. The time lag corresponding to the maximum energy-normalized cross-correlation corresponds to the relative time shift between the first-pass extrapolated waveform and the normally-decoded waveform associated with the first good frame(s), assuming the pitch cycle waveforms of the two are still roughly similar.

At decision step 406, a determination is made as to whether the time lag identified in step 404 is zero. If the time lag is zero, then the first-pass extrapolated waveform and the normally-decoded waveform are in phase and no more adjustment need be made. Thus, the first-pass extrapolated waveform may be used as the extrapolated waveform as shown at step 408. In this case, if the first good frame(s) are immediately after the lost frame (in other words, if the current frame is a lost frame and is the last frame in a frame erasure or packet loss), then a first portion of the first-pass extrapolated waveform can be used to generate a replacement waveform for the lost frame and a second portion of the first-pass extrapolated waveform can be overlap-added to the normally-decoded waveform associated with the first good frame(s) to obtain a smooth and gradual transition from the first-pass extrapolated waveform to the normally-decoded waveform. Since the two waveforms are in phase, there should not be any significant destructive interference resulting from the overlap-add operation.

If, on the other hand, the time lag identified in step 404 is not zero (that is, there is relative time shift between the extrapolated waveform and the normally-decoded waveform associated with the first good frame(s)), then this indicates that the pitch period has changed during the lost frame. In this case, rather than using a constant pitch period for extrapolation during the lost frame, the method of flowchart 400 calculates a pitch contour based on the identified time lag as shown at step 410. A second-pass periodic waveform extrapolation is then performed using the pitch contour to generate the extrapolated waveform, as shown at step 412. By performing the second-pass waveform extrapolation based on the pitch contour calculated in step 410, the method of flowchart 400 causes the extrapolated waveform produced by the method to be in phase with the normally-decoded waveform associated with the first good frame(s).

For simplicity, the new pitch period contour calculated in step 410 may be made to be linearly increasing or linearly decreasing, depending on whether the first-pass extrapolated waveform is leading or lagging the normally-decoded waveform associated with the first good frame(s), respectively. If the new pitch period contour is assumed to be linear, then it can be characterized by a single parameter: the amount of pitch period change per sample, which is basically the slope of the new linearly changing pitch period contour.

To adopt such an approach, the challenge then is to derive the amount of pitch period change per sample from the identified time lag between the first-pass extrapolated waveform and the decoded waveform associated with the first good frame(s) following the packet loss, given the pitch period of the frame preceding the lost frame and the length of the waveform extrapolation. This turns out to be a non-trivial mathematical problem.

After proper formulation of the problem and a fair amount of mathematical derivation, a closed-form solution to this problem has been found. Let $p_0$ be the pitch period of the frame immediately preceding the lost frame. Let l be the time lag corresponding to the maximum energy-normalized cross-correlation (that is, the time shift between the first-pass extrapolated waveform and the decoded waveform associated with the first good frame(s) following the lost frame). Let g be the "gap" length, or the number of samples from the end of the frame immediately preceding the lost frame to the middle of an overlap-add region in the first good frame after the packet loss. Let N be the integer portion of the number of pitch cycles in the first-pass extrapolated waveform from the end of the frame immediately preceding the lost frame to the middle of the overlap-add region of the first good frame after the packet loss. Then, it can be proven mathematically that Δ, the number of samples that the pitch period has changed in the first full pitch cycle, is given by:

$$\Delta = \frac{2lp_0}{(N+1)(2g - Np_0 - 2l)}.$$

Then, δ, the desired pitch period change per sample, is given by:

$$\delta = \frac{\Delta}{p_0 + \Delta}$$

-continued $$= \frac{2l}{(N+1)(2g - Np_0 - 2l) + 2l}.$$

Besides this pitch period change per sample, a scaling factor for periodic waveform extrapolation also needs to be calculated. The scaling factor c is used in the following equation for periodic extrapolation:

$$x(n) = cx(n-p),$$

where p is the pitch period, x(n) is the extrapolated signal at time index n, and x(n−p(n)) is the previously decoded signal at the time index n−p if n−p is in a previous frame, but it is the extrapolated signal at the time index n−p if n−p is in the current frame or a future frame.

If the gap length g is not greater than $p_0+\Delta$, then there is no more than one pitch period in the gap, so the scaling factor c can just be chosen as the maximum energy-normalized cross-correlation, which is also the optimal tap weight for a first-order long-term pitch predictor, as is well-known in the art. However, such a scaling factor may be too small if the cross-correlation is low. Alternatively, it may be better to derive c as the average magnitude of the decoded waveform in the target waveform matching windows in the first good frame divided by the average magnitude of the waveform that is one pitch period earlier.

If the gap length g is greater than $p_0+\Delta$, then there is more than one pitch period in the gap. In this case, the scaling factor will be applied m times if there are m pitch cycles in the gap. Therefore, if r is the ratio of the average magnitude of the decoded waveform in the target matching window over the average magnitude of the waveform that is m pitch periods earlier, then the desired scaling factor should be:

$$c = \sqrt[m]{r} = r^{1/m}.$$

Taking base-2 logarithm on both sides of the equation above gives:

$$\log_2 c = \frac{1}{m}\log_2 r$$

or $$c = 2^{\frac{1}{m}\log_2 r}.$$

This last equation is easier to implement in typical digital signal processors than the original m-th root expression above since power of 2 and base-2 logarithm are common functions supported in DSPs.

The value of m, or the number of pitch cycles in the gap, can be calculated in at least two ways. In a first way, the average pitch period during the gap is calculated as $$p_a = p_0 + \delta\left(\frac{g}{2}\right),$$

and then the number of pitch cycles in the gap is approximated as $$m = \frac{g}{p_a}.$$

Figure 5:
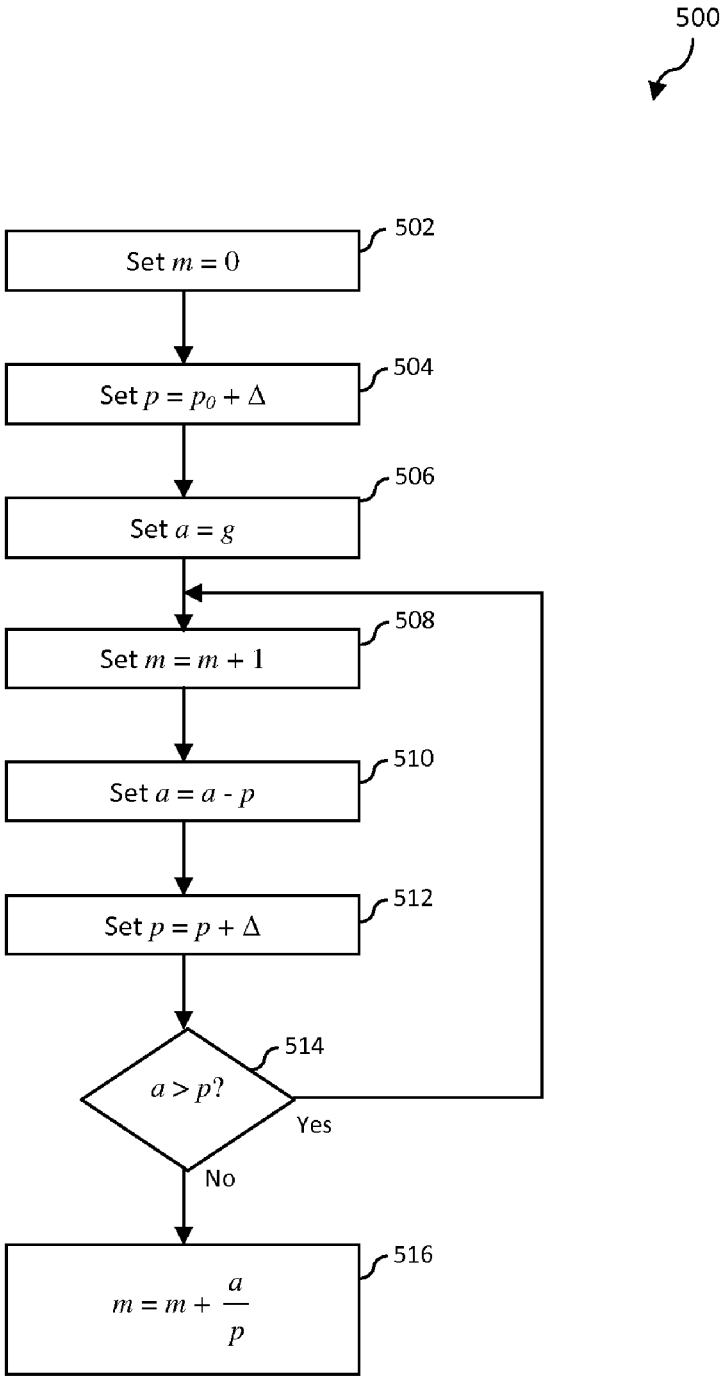
FIG. 5 depicts a flowchart of a method for calculating a number of pitch cycles in a gap between the end of a frame immediately preceding a lost frame and a middle of an overlap-add region in a first good frame following the lost frame in accordance with an embodiment of the present invention.

Alternatively, the value of m can be calculated more precisely using the algorithm represented by flowchart 500 of FIG. 5. As shown in FIG. 5, the algorithm begins with setting m=0, $p=p_0+\Delta$, and a=g at steps 502, 504 and 506, respectively. Then, steps 508, 510 and 512 are performed. Step 508 sets m=m+1, step 510 sets a=a−p, and step 512 sets p=p+Δ. Decision step 514 causes steps 508, 510 and 512 to be performed again if the condition a>p is met after the performance of these steps. If the condition a>p is not met in decision step 514, then control flows to step 516, which sets $$m = m + \frac{a}{p}.$$

After this, the scaling factor for the second-pass waveform extrapolation may be calculated as:

$$c = 2^{\frac{1}{m}\log_2 r},$$

and then c is checked and clipped to be range-bound if necessary. An appropriate upper bound for the value of c might be 1.5.

Once the values of δ and c are both calculated, the second-pass waveform extrapolation can then be started using the new pitch period contour that is changing linearly at a slope of δ samples per input sample. Such a gradually changing pitch contour generally results in non-integer pitch periods along the way.

There are many possible ways to perform such a waveform extrapolation with a non-integer pitch period. For example, when extrapolating a certain signal sample corresponds to copying a signal value that is one pitch period older between two actual signal samples because the pitch period is not an integer, then the signal value being copied can be obtained as some sort of signal interpolation between adjacent signal samples, as is well known in the art. However, this approach is computationally intensive.

Another much simpler way is to round the linearly increasing or decreasing pitch period to the nearest integer first before using it for extrapolation. Let p(n) be the linearly increasing or decreasing pitch period at the time index n, and let round(p(n)) be the rounded integer value of p(n). Then, the second-pass waveform extrapolation can be implemented as:

$$x(n)=cx(n-\text{round}(p(n))),$$

where x(n) is the extrapolated signal at the time index n and x(n−round(p(n))) is the previously decoded signal at the time index n−round(p(n)) if n−round(p(n)) is in a previous frame, but it is the extrapolated signal at the time index n−round(p(n)) if n−round(p(n)) is in the current frame or a future frame.

Although this rounding approach is simple to implement, it results in waveform discontinuities when the rounded pitch period round(p(n)) changes its value. Such waveform discontinuities may be avoided by using a particular overlap-add method. This overlap-add method is illustrated with an example below.

Suppose at time index k the rounded pitch period changes from 36 samples to 37 samples, and suppose the overlap-add length is 8 samples. Then, the periodic waveform extrapolation can be continued using the pitch period of 36 samples for another 8 samples corresponding to time indices k through k+7. Denote the resulting extrapolated waveform by $x_1(n)$ where n=k, k+1, k+2, . . . , k+7. In addition, the system also performs periodic waveform extrapolation using the new pitch period of 37 samples for 8 samples corresponding to time indices k through k+7. Denote the resulting extrapolated waveform by $x_2(n)$ where n=k, k+1, k+2, . . . , k+7. Then, $x_1(n)$ is multiplied by a fade-out window (such as a downward triangular window) and $x_2(n)$ is multiplied by a fade-in window (such as an upward triangular window). The two windowed signals are then overlap-added. As is well known in the art, the sum of the fade-out window and the fade-in window will equal unity for all samples within the windows. This will produce a smooth waveform transition from a pitch period of 36 samples to a pitch period of 37 samples over the duration of the 8-sample overlap-add period. After the overlap-add period is over, starting from the time index k+8, the system resumes the normal periodic waveform extrapolation operation using a pitch period of 37 samples until the rounded pitch period becomes 38 samples, at which point the 8-sample overlap-add operation is repeated to obtain a smooth waveform transition from a pitch period of 37 samples to a pitch period of 38 samples. Such an overlap-add method smoothes out the waveform discontinuities due to a sudden jump in the pitch period due to the rounding operations on the pitch period.

If the overlap-add length is chosen to be the number of samples between two adjacent changes of the rounded pitch period, then the approach of pitch period rounding plus overlap-add using triangular windows effectively approximates a gradually changing pitch period contour with a linear slope.

Such a second-pass waveform extrapolation based on pitch period rounding plus overlap-add requires very low computational complexity, and after such extrapolation is done, the second-pass extrapolated waveform normally would be properly aligned with the decoded waveform associated with the first good frame(s) after a packet loss. Therefore, destructive interference (and the corresponding partial cancellation of waveform) during the overlap-add operation in the first good frame(s) is largely avoided. This can often results in fairly substantial and audible improvement of the output audio quality.

C. Hardware and Software Implementations

Figure 6:
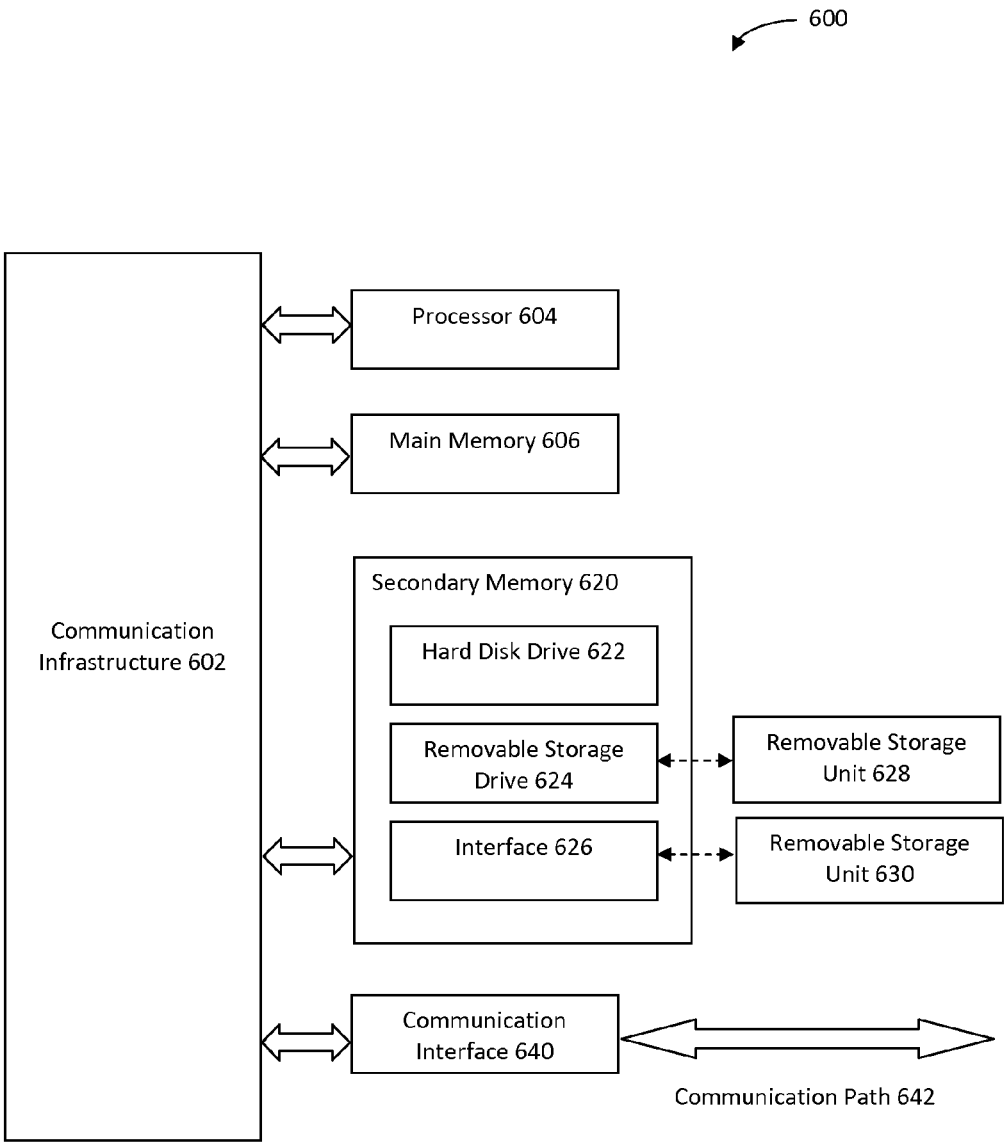
FIG. 6 is a block diagram of a computer system in which embodiments of the present invention may be implemented.

The following description of a general purpose computer system is provided for the sake of completeness. The present invention can be implemented in hardware, or as a combination of software and hardware. Consequently, the invention may be implemented in the environment of a computer system or other processing system. An example of such a computer system 600 is shown in FIG. 6. In the present invention, all of the steps of FIGS. 1-5, for example, can execute on one or more distinct computer systems 600, to implement the various methods of the present invention. The computer system 600 includes one or more processors, such as processor 604. Processor 604 can be a special purpose or a general purpose digital signal processor. The processor 604 is connected to a communication infrastructure 602 (for example, a bus or network). Various software implementations are described in terms of this exemplary computer system. After reading this description, it will become apparent to a person skilled in the relevant art(s) how to implement the invention using other computer systems and/or computer architectures.

Computer system 600 also includes a main memory 606, preferably random access memory (RAM), and may also include a secondary memory 620. The secondary memory 620 may include, for example, a hard disk drive 622 and/or a removable storage drive 624, representing a floppy disk drive, a magnetic tape drive, an optical disk drive, or the like. The removable storage drive 624 reads from and/or writes to a removable storage unit 628 in a well known manner. Removable storage unit 628 represents a floppy disk, magnetic tape, optical disk, or the like, which is read by and written to by removable storage drive 624. As will be appreciated, the removable storage unit 628 includes a computer usable storage medium having stored therein computer software and/or data.

In alternative implementations, secondary memory 620 may include other similar means for allowing computer programs or other instructions to be loaded into computer system 600. Such means may include, for example, a removable storage unit 630 and an interface 626. Examples of such means may include a program cartridge and cartridge interface (such as that found in video game devices), a removable memory chip (such as an EPROM, or PROM) and associated socket, and other removable storage units 630 and interfaces 626 which allow software and data to be transferred from the removable storage unit 630 to computer system 600.

Computer system 600 may also include a communications interface 640. Communications interface 640 allows software and data to be transferred between computer system 600 and external devices. Examples of communications interface 640 may include a modem, a network interface (such as an Ethernet card), a communications port, a PCMCIA slot and card, etc. Software and data transferred via communications interface 640 are in the form of signals which may be electronic, electromagnetic, optical, or other signals capable of being received by communications interface 640. These signals are provided to communications interface 640 via a communications path 642. Communications path 642 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 628 and 630, a hard disk installed in hard disk drive 622, and signals received by communications interface 640. These computer program products are means for providing software to computer system 600.

Computer programs (also called computer control logic) are stored in main memory 606 and/or secondary memory 620. Computer programs may also be received via communications interface 640. Such computer programs, when executed, enable the computer system 600 to implement the present invention as discussed herein. In particular, the computer programs, when executed, enable the processor 600 to implement the processes of the present invention, such as any of the methods described herein. Accordingly, such computer programs represent controllers of the computer system 600.

Where the invention is implemented using software, the software may be stored in a computer program product and loaded into computer system 600 using removable storage drive 624, interface 626, or communications interface 640.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

D. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method for concealing a lost segment in a speech or audio signal that comprises a series of segments, the method comprising:

(a) generating an extrapolated waveform based on a segment that precedes the lost segment in the series of segments and on one or more segments that follow the lost segment in the series of segments;

(b) generating a replacement waveform for the lost segment based on a first portion of the extrapolated waveform; and (c) overlap-adding a second portion of the extrapolated waveform with a decoded waveform associated with the one or more segments following the lost segment in the series of segments;

wherein step (a) comprises:

performing a first-pass periodic waveform extrapolation using a pitch period associated with the segment that precedes the lost segment to generate a first-pass extrapolated waveform;

identifying a time lag between the first-pass extrapolated waveform and the decoded waveform associated with the one or more segments that follow the lost segment;

calculating a pitch contour based on the identified time lag; and performing a second-pass periodic waveform extrapolation using the pitch contour to generate the extrapolated waveform; and wherein at least one of steps (a), (b) and (c) is performed by a processor.

2. The method of claim 1, wherein identifying the time lag between the first-pass extrapolated waveform and the decoded waveform associated with the one or more segments that follow the lost segment comprises:

locating a peak of an energy-normalized cross-correlation function between the first-pass extrapolated waveform and the decoded waveform associated with the one or more segments that follow the lost segment.

3. The method of claim 1, wherein calculating the pitch contour comprises determining an amount of pitch period change per sample.

4. The method of claim 3, wherein determining the amount of pitch period change per sample comprises calculating:

$$\delta = \frac{2l}{(N+1)(2g - Np_0 - 2l) + 2l},$$

wherein δ is the amount of pitch period change per sample, l is the identified time lag, $p_0$ is the pitch period associated with the segment that precedes the lost segment, g is a number of samples from the end of the segment that precedes the lost segment to a middle of an overlap-add region in the first of the one or more segments that follow the lost segment, and N is an integer portion of a number of pitch cycles in the first-pass extrapolated waveform from the end of the segment that precedes the lost segment to the middle of the overlap-add region in the first of the one or more segments that follow the lost segment.

5. The method of claim 1, further comprising:

determining if the one or more segments that follow the lost segment are available; and performing steps (a), (b) and (c) responsive only to a determination that the one or more segments that follow the lost segment are available.

6. The method of claim 5, further comprising:

performing a packet loss concealment technique that generates an extrapolated waveform based on the segment that precedes the lost segment in the series of segments but not on any segment that follows the lost segment in the series of segments responsive to a determination that the one or more segments that follow the lost segment are not available.

7. The method of claim 5, further comprising:

determining if the segment that precedes the lost segment and the first of the one or more segments that follow the lost segment are deemed voiced segments; and performing steps (a), (b) and (c) responsive only to a determination that the one or more segments that follow the lost segment are available and that the segment that precedes the lost segment and the first of the one or more segments that follow the lost segment are deemed voiced segments.

8. The method of claim 1, wherein performing the second-pass periodic waveform extrapolation using the pitch contour to generate the extrapolated waveform comprises calculating a scaling factor in accordance with:

$$c = r^{1/m},$$

or a mathematically equivalent formula, wherein c is the scaling factor, m is a number of pitch cycles in a gap that extends from the end of the segment that precedes the lost segment to a middle of an overlap-add region in the first of the one or more segments that follow the lost segment, and r is a ratio of an average magnitude of a decoded waveform in a target matching window over an average magnitude of a waveform that is m pitch periods earlier.

9. A computer program product comprising a computer-readable storage unit having computer program logic recorded thereon for enabling a processor to conceal a lost segment in a speech or audio signal that comprises a series of segments, the computer program logic comprising:

first means for enabling the processor to generate an extrapolated waveform based on a segment that precedes the lost segment in the series of segments and on one or more segments that follow the lost segment in the series of segments;

second means for enabling the processor to generate a replacement waveform for the lost segment based on a first portion of the extrapolated waveform; and third means for enabling the processor to overlap-add a second portion of the extrapolated waveform with a decoded waveform associated with the one or more segments following the lost segment in the series of segments;

wherein the first means comprises:

means for enabling the processor to perform a first-pass periodic waveform extrapolation using a pitch period associated with the segment that precedes the lost segment to generate a first-pass extrapolated waveform;

means for enabling the processor to identify a time lag between the first-pass extrapolated waveform and the decoded waveform associated with the one or more segments that follow the lost segment;

means for enabling the processor to calculate a pitch contour based on the identified time lag; and means for enabling the processor to perform a second-pass periodic waveform extrapolation using the pitch contour to generate the extrapolated waveform.

10. The computer program product of claim 9, wherein the means for enabling the processor to identify the time lag between the first-pass extrapolated waveform and the decoded waveform associated with the one or more segments that follow the lost segment comprises:

means for enabling the processor to locate a peak of an energy-normalized cross-correlation function between the first-pass extrapolated waveform and the decoded waveform associated with the one or more segments that follow the lost segment.

11. The computer program product of claim 9, wherein the means for enabling the processor to calculate the pitch contour comprises means for enabling the processor to determine an amount of pitch period change per sample.

12. The computer program product of claim 11, wherein the means for enabling the processor to determine the amount of pitch period change per sample comprises means for enabling the processor to calculate:

$$\delta = \frac{2l}{(N+1)(2g - Np_0 - 2l) + 2l},$$

wherein δ is the amount of pitch period change per sample, l is the identified time lag, $p_0$ is the pitch period associated with the segment that precedes the lost segment, g is a number of samples from the end of the segment that precedes the lost segment to a middle of an overlap-add region in the first of the one or more segments that follow the lost segment, and N is an integer portion of a number of pitch cycles in the first-pass extrapolated waveform from the end of the segment that precedes the lost segment to the middle of the overlap-add region in the first of the one or more segments that follow the lost segment.

13. The computer program product of claim 9, further comprising:

means for enabling the processor to determine if the one or more segments that follow the lost segment in the series of segments are available; and means for enabling the processor to invoke the first means, second means and third means responsive only to a determination that the one or more segments that follow the lost segment are available.

14. The computer program product of claim 13, further comprising:

means for enabling the processor to perform a packet loss concealment technique that generates an extrapolated waveform based on the segment that precedes the lost segment but not on any segment that follows the lost segment in the series of segments responsive to a determination that the one or more segments that follow the lost segment are not available.

15. The computer program product of claim 13, further comprising:

means for enabling the processor to determine if the segment that precedes the lost segment and the first of the one or more segments that follow the lost segment are deemed voiced segments; and means for enabling the processor to invoke the first means, second means and third means responsive only to a determination that the one or more segments that follow the lost segment are available and that the segment that precedes the lost segment and the first of the one or more segments that follow the lost segment are deemed voiced segments.

16. The computer program product of claim 9, wherein the means for enabling the processor to perform the second-pass periodic waveform extrapolation using the pitch contour to generate the extrapolated waveform comprises:

means for calculating a scaling factor in accordance with:

$$c=r^{1/m},$$

or a mathematically equivalent formula, wherein c is the scaling factor, m is a number of pitch cycles in a gap that extends from the end of the segment that precedes the lost segment to a middle of an overlap-add region in the first of the one or more segments that follow the lost segment, and r is a ratio of an average magnitude of a decoded waveform in a target matching window over an average magnitude of a waveform that is m pitch periods earlier.

17. A method for concealing a lost segment in a speech or audio signal that comprises a series of segments, the method comprising:

determining if one or more segments that follow the lost segment in the series of segments are available;

if one or more segments that follow the lost segment in the series of segments are available, determining if the segment that precedes the lost segment and the first of the one or more segments that follow the lost segments are deemed voiced segments;

performing packet loss concealment using periodic waveform extrapolation based on a segment that precedes the lost segment in the series of segments and on the one or more segments that follow the lost segment responsive to a determination that the one or more segments that follow the lost segment are available and to a determination that the segment that precedes the lost segment and the first of the one or more segments that follow the lost segment are deemed voiced segments; and performing packet loss concealment using waveform extrapolation based on the segment that precedes the lost segment but not on any segments that follow the lost segment responsive to a determination that the one or more segments that follow the lost segment are not available or to a determination that either the segment that precedes the lost segment or the first of the one or more segments that follow the lost segment is not deemed a voiced segment;

wherein at least one of the determining or performing steps is performed by a processor.

18. A computer program product comprising a computer-readable storage unit having computer program logic recorded thereon for enabling a processor to conceal a lost segment in a speech or audio signal that comprises a series of segments, the computer program logic comprising:

first means for enabling the processor to determine if one or more segments that follow the lost segment in the series of segments are available;

second means for enabling the processor to determine if the segment that precedes the lost segment and the first of the one or more segments that follow the lost segments are deemed voiced segments if one or more segments that follow the lost segment in the series of segments are available;

third means for enabling the processor to perform packet loss concealment using periodic waveform extrapolation based on a segment that precedes the lost segment in the series of segments and on the one or more segments that follow the lost segment responsive to a determination that the one or more segments that follow the lost segment are available and to a determination that the segment that precedes the lost segment and the first of the one or more segments that follow the lost segment are deemed voiced segments; and fourth means for enabling the processor to perform packet loss concealment using waveform extrapolation based on the segment that precedes the lost segment but not on any segments that follow the lost segment responsive to a determination that the one or more segments that follow the lost segment are not available or to a determination that either the segment that precedes the lost segment or the first of the one or more segments that follow the lost segment is not deemed a voiced segment.

* * * * *